US008286856B2

(12) United States Patent
Meyerhofer et al.

(10) Patent No.: US 8,286,856 B2
(45) Date of Patent: Oct. 16, 2012

(54) MODULAR GAMING TRANSACTION PRINTER

(75) Inventors: Eric Meyerhofer, Pasadena, CA (US); John J. Hilbert, Torrance, CA (US); Wayne Loynes, Altadena, CA (US)

(73) Assignee: FutureLogic, Inc., Glendale, CA (US)

( * ) Notice: Subject to any disclaimer, the term of this patent is extended or adjusted under 35 U.S.C. 154(b) by 503 days.

(21) Appl. No.: 12/441,131

(22) PCT Filed: Sep. 12, 2007

(86) PCT No.: PCT/US2007/078319

§ 371 (c)(1), (2), (4) Date: Jun. 17, 2009

(87) PCT Pub. No.: WO2008/033958

PCT Pub. Date: Mar. 20, 2008

(65) Prior Publication Data

US 2011/0101084 A1 May 5, 2011

Related U.S. Application Data

(60) Provisional application No. 60/825,372, filed on Sep. 12, 2006.

(51) Int. Cl.
*G07G 1/00* (2006.01)

(52) U.S. Cl. ..... 235/3; 235/61 R; 463/25

(58) Field of Classification Search ..... 235/3, 61 R; 463/25, 29, 30

See application file for complete search history.

(56) References Cited

U.S. PATENT DOCUMENTS

2007/0129136 A1* 6/2007 Walker et al. ..... 463/25
2010/0030635 A1* 2/2010 Meyerhofer ..... 705/14.25
2010/0093446 A1* 4/2010 Mkrtchyan et al. ..... 463/47

* cited by examiner

*Primary Examiner* — Ahshik Kim
(74) *Attorney, Agent, or Firm* — Frank L. Cire

(57) ABSTRACT

A modular gaming transaction printer for grayscale printing which may interface with multiple host systems and multiple gaming machine protocols, download application code or code patches, receive printer maintenance instructions, arbitrate print jobs received from various communication interfaces, support worldwide languages, and utilize firmware version consolidation. The printer further includes security features and memory protection. The printer further includes segmented memory for content related to each communication interface, gaming machine, or host system, among others. Additionally, the printer supports Unicode, configuration to worldwide languages, configuration to multiple protocols, and configuration to prior firmware versions for backward compatibility, among others. The printer may include a plurality of paper trays to hold media of the same size, but different characteristics.

13 Claims, 14 Drawing Sheets

300

400

MODULAR GAMING TRANSACTION PRINTER

CROSS-REFERENCE TO RELATED APPLICATION(S)

The present application claims the benefit us U.S. Provisional Application No. 60/825,372 filed Sep. 12, 2006 the contents of which are incorporated by reference as if stated in full herein.

BACKGROUND OF THE INVENTION

1. Field of the Invention

This invention relates to gaming and gaming printers, more specifically to a modular gaming transaction printers for grayscale printing.

2. Background

Over the last several years, cashless enabled games have found an increasing acceptance and use in the gaming industry with both the players, who enjoy the speed of play and ease of transporting their winnings around the casino, and the casinos who have realized significant labor savings in the form of reduced coin hopper reloads in the games, and an increase in revenue due to speed of play. Practical field experience with the application has illustrated that there are areas for improvement in current printer designs and implementation within the game.

One area for improvement relates to the print head of the printer. Currently, the print heads in related printers are limited to a palette of one color pixels, meaning a black and white image. This invention offers an improvement to existing methods and apparatus by the use of a print head capable of printing grayscale.

Another area for improvement relates to the paper tray. Currently, only one paper tray is in use in related printers. This presents a challenge should a gaming establishment desire to use more than one supply of paper, for instance one paper supply for coupons and another for vouchers.

Another area for improvement relates to the printing of both vouchers and promotional coupons. Currently, paper is pulled from one paper tray for both vouchers and coupons. Additionally, the voucher must be printed first, followed by one or more coupons.

Another area for improvement relates to the printer firmware. Currently, a firmware version must be created for each worldwide language to meet the various domestic and international requirements for gaming. Additionally, a firmware version must be created for each custom variation of a firmware version based on regional or jurisdictional specific information requirements, such as dual barcodes. The problem with the current situation is that as the gaming market continues to grow, any future expansion may become unmanageable as multiple firmware versions based on one firmware version will exist. This potentially unmanageable situation may be detrimental to a Gaming Establishment specifically since regulatory requirements and approvals are based on firmware versions. The use of the wrong version may cause the shut down of a Gaming Establishment by a regulatory agency.

Another area for improvement is supporting multiple host and multiple game protocols. Currently, a firmware version must exist for each protocol. These protocols include RS232, USB, Netplex, EPI, and Ethernet, among others. A drawback to the current situation is that firmware, including required communication drivers and jurisdictional content, must be reloaded each time a printer is placed to another system with a different protocol.

DEFINITIONS

For the purposes of this document the following definitions apply:

"Gaming Establishment"—A casino in the traditional sense, or other place where gambling takes place.

"Gaming Machine" or "Slot Machine"—A casino electromechanical game of chance. A Slot Machine as it is known is a sub-set of such games.

"Gaming Voucher"—A media, such as paper, containing sufficient information to identify at a minimum, an amount of money and a validation number use to authenticate the transaction.

"Promotional Coupon"—A media, such as paper, containing sufficient information to identify at a minimum, a promotional offer made to a patron.

"Host System"—A computer, back-end system, or gaming machine that sends and/or receives information to and/or from the printer.

"Bluetooth"—short range wireless technology for connecting different devices such as a printer and a personal digital assistant (PDA).

"WiFi"—a network that uses high frequency radio signals for data transmission over distances of a few hundred feet.

"Grayscale Images or Graphics"—images or graphics with multiple pixels where the value of each pixel is composed of shades of gray or another color.

"One Color Images or Graphics"—images with a single pixel of either black or white.

"Thermal Printers"—a printer where paper with a heat sensitive side is imaged using a print head which applies heat in tiny dots (1/200th of an inch in size or smaller) in order to turn the area black. In this manner, all images are created by a series of tiny black dots. A widely known example of a thermal printer is the original fax machines.

"Thermal Media"—a type paper with a heat sensitive side is imaged using a print head which applies heat in tiny dots (1/200th of an inch in size or smaller) in order to turn the area black or another color.

SUMMARY OF THE INVENTION

A modular gaming transaction printer is provided including the mechanical, electrical and electronic devices, and software processes necessary to interface with multiple host systems and multiple gaming machine protocols, download application code or code patches, receive printer maintenance instructions, arbitrate print jobs received from various communication interfaces, support worldwide languages, and utilize firmware version consolidation whereby fewer firmware versions are required to support worldwide requirements, such as regional and jurisdictional requirements. The printer further includes security features such as encryption for gaming regulatory requirements, memory protection, and preventing the execution of downloaded code on unauthorized hardware. The printer further includes segmented memory for content related to each communication interface, gaming machine, or host system, among others. Additionally, the printer supports Unicode, configuration to worldwide languages, configuration to multiple protocols, and configuration to prior firmware versions for backward compatibility, among others. The printer may include a plurality of paper trays to hold media of the same size, but different characteristics.

The present invention provides a solution to the above-described problems by allowing one integrated firmware version that utilizes Unicode to support each worldwide language, such as German, Korean, or Japanese. The benefit to using the present invention is as the one integrated firmware version resides in the printer, a Gaming Establishment may easily, efficiently, and securely implement cashless enabled games and gaming in various countries, regions, or jurisdictions without the need to create another firmware version specifically for each country, region, or jurisdiction. Supporting this benefit, the present invention provides a localized method by which a Gaming Establishment may configure the printer to a specific location.

Additionally, the present invention provides a solution to regional and jurisdictional requirements by providing regional and jurisdictional message processing whereby custom variations in a firmware version may exist with only one firmware version.

The present invention provides a solution to firmware security problems by permitting all protocols to coexist in the firmware whereby security measures and various means are used to allow the printer to detect which protocol it is using.

The present invention offers an improvement to existing printers by using multiple paper trays feeding into one paper path, thereby allowing multiple supplies of paper to be printed from a single printer without changing the paper source.

This invention offers an improvement to existing printers by using multiple paper trays and a session escrow area thereby allowing the printer to print coupons after receiving a cash-in signal from a host system either at the beginning or middle of a player session and storing the coupons in the session escrow area until the printer receives a cash-out signal from a host system.

In another aspect of the invention, a modular gaming transaction printer for grayscale printing includes the mechanical, electrical and electronic means, and software processes necessary to interface with multiple host systems and multiple gaming machine protocols, download application code or code patches, receive printer maintenance instructions, arbitrate print jobs received from various communication interfaces, support worldwide languages, and utilize firmware version consolidation whereby fewer firmware versions are required to support worldwide requirements, such as regional and jurisdictional requirements. The printer further includes security features such as encryption for gaming regulatory requirements, memory protection, and preventing the execution of downloaded code on unauthorized hardware. The printer further includes segmented memory for content related to each communication interface, gaming machine, or host system, among others. Additionally, the printer supports Unicode, configuration to worldwide languages, configuration to multiple protocols, and configuration to prior firmware versions for backward compatibility, among others. The printer may include a plurality of paper trays to hold media of the same size, but different characteristics.

In one aspect of the invention, a modular gaming transaction printer allows for grayscale printing whereby the printer prints multiple shades of a foreground color on a background color.

In another aspect of the invention, a modular gaming transaction printer stores images resident in the memory of the printer.

In another aspect of the invention, a modular gaming transaction printer permits the download of images to the printer.

In another aspect of the invention, a modular gaming transaction printer includes one or a plurality of paper trays where one paper tray may be used to hold media for use with promotional coupons and another tray may be used to hold media for use with cashout vouchers.

In another aspect of the invention, the gaming transaction printer includes a plurality of paper trays holding media where the media may be color media, grayscale media, or black and white media.

In another aspect of the invention, a modular gaming transaction printer is coupled to a print head and includes one paper path where media from one or a plurality of paper trays is routed through to the print head for printing of promotional coupons and cashout vouchers.

In another aspect of the invention, a modular gaming transaction printer includes one or a plurality of media escrow sections where one or all sections may be accessed externally to the printer.

In another aspect of the invention, a modular gaming transaction printer allows for mid-session or begin session coupon printing after a game coupled to such printer receives a cash-in signal.

In another aspect of the invention, a modular gaming transaction printer is configured to print one or a plurality of media and hold such media in escrow in a media escrow section waiting for other media to be printed.

In another aspect of the invention, a modular gaming transaction printer is configured to hold scrap printed or unprinted media in one or a plurality of media escrow sections.

In another aspect of the invention, a modular gaming transaction printer is configured to interface and communicate with other devices using wireless technology such as Bluetooth, WiFi, wireless USB, among others where such interfacing may occur simultaneously with other functions or processes of the printer such as printing.

In another aspect of the invention, a modular gaming transaction printer is configured to interface and communicate with other devices using wireless technology, the other devices may include devices such as PDAs, personal computers, local or wide area networks, handheld devices, routers, gaming machines such as a slot machine, vending machines or kiosks, among others.

In another aspect of the invention, a modular gaming transaction printer is configured to interface with one or a plurality of removable memory devices such as a memory stick or FLASH stick, among others, each removable memory device may be internal or external to the printer.

In another aspect of the invention, the contents of a removable memory device may include promotional coupon data such as graphics and templates, trigger metrics, promotional campaigns as well as language and font packs, and firmware to upload, among others.

In another aspect of the invention, a modular gaming transaction printer utilizing a plating process of aluminum or copper plating to provide electrical grounding for the printer.

In another aspect of the invention, a modular gaming transaction printer is configured to route wiring through the printer to provide simpler ground wiring.

In another aspect of the invention, a modular gaming transaction printer is configured to permit the snap-in retention or snap mount of one or a plurality of boards and/or components to ease servicing and/or replacement of boards and/or components.

In another aspect of the invention, a modular gaming transaction printer removably coupled to a lid where components of the lid such as a lock, lid latch, and burster bar may be molded into the lid or removably coupled to the lid.

In another aspect of the invention, a modular gaming transaction printer includes a processor, memory, firmware, processes, programming logic, print mechanism, a storage device, a printer controller, and a plurality of communication interfaces such as a communication port or driver.

In another aspect of the invention, the modular gaming transaction printer includes a communication interface for connection to a host system, plurality of host systems, or gaming machine whereby the printer may receive instructions to generate a gaming voucher, promotional coupon, plurality of any, combination of any, configuration to worldwide languages, configuration to one or multiple protocols, configuration to prior firmware versions for backward compatibility, code patches, printer maintenance instructions, application code including code from host system applications, gaming applications, promotional applications, and application code patches, among other types of information, for use in the printer.

In another aspect of the invention, the modular gaming transaction printer includes a communication interface for connection to an external device, whereby the printer may receive from an external device configuration to worldwide languages, configuration to one or multiple protocols configuration to prior firmware versions for backward compatibility, code patches, printer maintenance instructions, application code including code from host system applications, gaming applications, promotional applications, and application code patches, among other types of information, for use in the printer.

In another aspect of the invention, the modular gaming transaction printer includes multiple drivers to interface to a plurality of host systems.

In another aspect of the invention, the modular gaming transaction printer includes multiple concurrent drivers to interface to a plurality of gaming machines.

In another aspect of the invention, the modular gaming transaction printer using memory, processes, programming logic, and firmware allows for firmware version consolidation whereby fewer firmware versions are required to support worldwide requirements, such as language and regional and jurisdictional requirements.

In another aspect of the invention, the modular gaming transaction printer using firmware, memory, processes, and programming logic include a security attribute for regulatory requirements, whereby the security attribute separates and segments the code and memory for each communication interface to the printer.

In another aspect of the invention, the modular gaming transaction printer using memory, processes, and programming logic include a security attribute to protect the printer memory and portions thereof from unauthorized reading or writing.

In another aspect of the invention, the modular gaming transaction printer using memory, processes, and programming logic include a security attribute to prevent the execution of downloaded code on unauthorized hardware.

In another aspect of the invention, the memory of the modular gaming transaction printer is segmented.

In another aspect of the invention, a portion of the segmented memory of the printer is utilized for gaming machine content such as machine implementation information, application code, mapping to specific gaming machine regions, templates, ticket files, coupon files, or gaming code patches.

In another aspect of the invention, a portion of the segmented memory of the printer is utilized for coupon information such as promotion implementation information, application code, mapping to ticket files, coupon files, printer regions, or promotion code patches.

In another aspect of the invention, a portion of the segmented memory of the printer is utilized for host system content such as implementation information, application code, and mapping to ticket files, coupon files, printer regions, or code patches.

In another aspect of the invention, a portion of the segmented memory of the printer is utilized for mapping to a main communication interface, the mapping may further include identifying the gaming machine connected to the communication interface, mapping ticket files, mapping coupon files, downloaded gaming application code, downloaded promotion application code, templates, and code patches, and maintenance functions, among others.

In another aspect of the invention, a portion of the segmented memory of the printer is utilized for mapping to a secondary communication interface, the mapping may further include identifying the host machine connected to the communication interface, mapping ticket files, mapping coupon files, downloaded gaming application code, downloaded promotion application code, templates, and code patches, and maintenance functions, among others.

In another aspect of the invention, a portion of the segmented memory of the printer is utilized for mapping to an auxiliary communication interface, the mapping may further include downloaded gaming application code, download promotion application code, templates, and code patches, and maintenance functions, among others.

In another aspect of the invention, the firmware, memory, processes, and programming allow for the determination of the existence of custom variations in a firmware version.

In another aspect of the invention, the modular gaming transaction printer and components thereof are configured to interface to different host systems protocols.

In another aspect of the invention, the modular gaming transaction printer and components thereof are configured to simultaneously interface to different host systems protocols.

In another aspect of the invention, the modular gaming transaction printer and components thereof are configured to detect different host system communication interfaces and automatically detect and connect to different host protocols.

In another aspect of the invention, the modular gaming transaction printer and components thereof are configured to interface to different gaming machine protocols.

In another aspect of the invention, the modular gaming transaction printer and components thereof are configured to simultaneously interface to different gaming machines protocols.

In another aspect of the invention, the modular gaming transaction printer and components thereof are configured to detect different gaming machines communication interfaces and automatically detect and connect to different gaming machine protocols.

In another aspect of the invention, the modular gaming transaction printer and components thereof are configured to segment code and data of each adaptation or protocol to insure no cross effects of new code modifications or adaptations.

In another aspect of the invention, the modular gaming transaction printer allows for generating or printing financial transaction records such as gaming vouchers, promotional coupons and other printed items of interest to a Gaming Establishment or its patrons.

In another aspect of the invention, the modular gaming transaction printer is configured to detect a connection made on any or all communication interfaces.

In another aspect of the invention, the modular gaming transaction printer and components thereof are configured to receive configuration data related to a specific country, region, or jurisdiction, or a plurality of countries, regions, or jurisdictions.

In another aspect of the invention, the modular gaming transaction printer using a processor, memory, processes, and programming logic is configured to detect to which host system protocol or plurality of protocols it is coupled, the protocol of each host system may include RS232, EPI, or Ethernet, among others.

In another aspect of the invention, the modular gaming transaction printer using a processor, memory, processes, and programming logic is configured to detect to which gaming machine protocol or plurality of protocols it is coupled, the protocol of each gaming machine may include USB, RS232, Netplex, or GSA, among others.

In another aspect of the invention, the modular gaming transaction printer using a communication interface, programming logic, memory, and processes is configured to accept initial game configuration of multiple variations in one data packet.

In another aspect of the invention, the modular gaming transaction printer using a processor, memory, processes, and one or a plurality of communication interfaces is configured to download application code from a host system or host systems to which the printer is connected, the application code including code from host system applications, gaming applications, promotional applications, and application code patches, among others.

In another aspect of the invention, the modular gaming transaction printer using a processor, memory, processes, and one or a plurality of communication interfaces is configured to download application code from a gaming machine to which the printer is connected, the application code including code from gaming applications, promotional applications, and application code patches, among others.

In another aspect of the invention, the modular gaming transaction printer using a processor, memory, processes, and programming logic is configured to arbitrate print jobs received from one or a plurality of communication interfaces, such as a gaming voucher data from the main communication interface and promotional data from a secondary communication interface.

In another aspect of the invention, the modular gaming transaction printer using a processor, memory, processes, programming logic, and firmware is configured to support multiple worldwide languages, the printer further configured to detect which worldwide language is in use.

In another aspect of the invention, the modular gaming transaction printer using memory, processes, programming logic, and firmware is configured to uniquely identify worldwide languages.

In another aspect of the invention, the modular gaming transaction printer using memory, processes, programming logic, and firmware is configured to uniquely identify worldwide regions.

In another aspect of the invention, the modular gaming transaction printer using memory, processes, programming logic, and firmware is configured to uniquely identify worldwide jurisdictions.

In another aspect of the invention, the encoding method utilized in the modular gaming transaction printer supports Unicode.

In another aspect of the invention, the modular gaming transaction printer and components thereof are configured to print Unicode and other character transformation formats.

In another aspect of the invention, the modular gaming transaction printer and components thereof are configured to accept the download of code and data from a host system.

In another aspect of the invention, the modular gaming transaction printer and components thereof are configured to automatically negotiate the connection to the gaming machine.

In another aspect of the invention, the modular gaming transaction printer and components thereof are configured to automatically negotiate the connection to the host system via a secondary communication interface.

BRIEF DESCRIPTION OF THE DRAWINGS

These and other features, aspects, and advantages of the present invention will become better understood with regard to the following description and accompanying drawings where.

DETAILED DESCRIPTION

Figure 1:
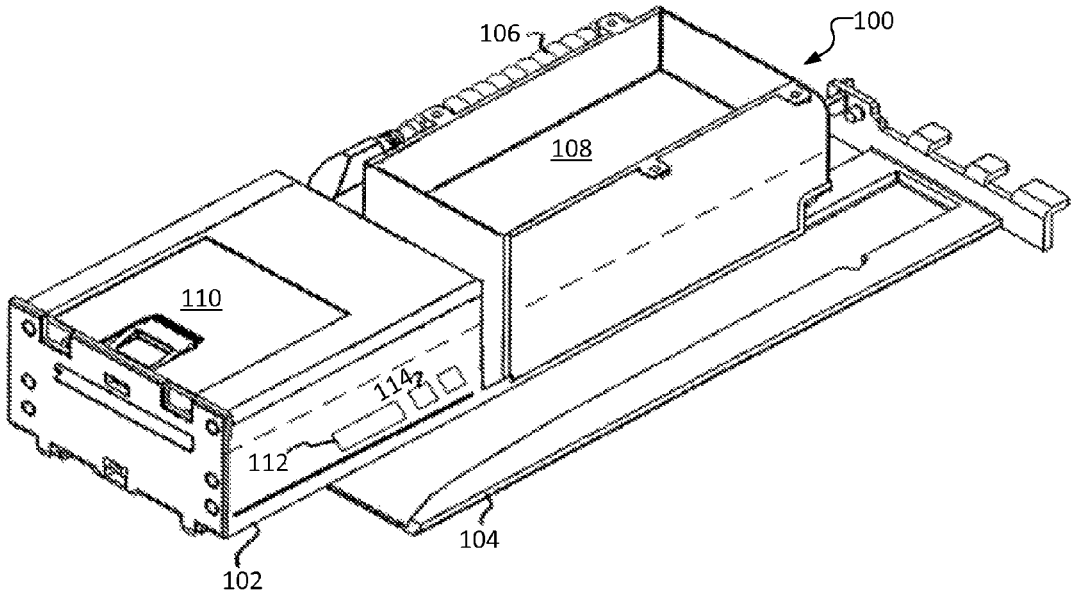
FIG. 1 is a top and side view of a modular gaming transaction printer and components thereof in accordance with an exemplary embodiment of the present invention.

FIG. 1 is a top and side view of a modular gaming transaction printer and components thereof in accordance with an exemplary embodiment of the present invention.

As illustrated, the modular gaming transaction printer includes a mobile module 102 slidably and removably coupled to a stationary module 104. In one embodiment of a modular gaming transaction printer in accordance with the present invention, a coiled electrical cable 106 is used to connect the mobile module to the stationary module. The coiled electrical cable includes power, communication, and other signals required for the operation of the mobile module and the stationary module included in the modular gaming transaction printer. As the coiled electrical cable, similar to a coiled cable connecting a telephone handset to its base, is designed to be flexible, the coiled cable does not experience excessive wear during repeated accesses by an attendant for maintenance and replenishing a supply of blank vouchers held in the storage area or paper tray 108 of the printer. A more detailed discussion of the printer and components thereof is presented in U.S. Patent Application entitled "GAMING MACHINE PRINTER" published as U.S. Publication Number 20040132529, and in U.S. Patent Application entitled "GAMING MACHINE PRINTER" published as U.S. Publication Number 20050109810, the contents of which are hereby incorporated by reference as if stated herein in full as well as later disclosed in FIG. 2.

The mobile module of the printer includes two primary components: a print module and one or a plurality of paper trays. The print module may be used to house the electronic components and other components of a modular gaming transaction printer. These components may include the main electronics board, print head, session escrow area, one or a plurality of wireless device interfaces, and one or a plurality of removable memory device interfaces, among others.

The print head includes the means by which a modular gaming transaction printer may print vouchers and/or promotional coupons using grayscale printing whereby the printer may print multiple shades of a foreground color on a background color. For example, a promotional coupon such as that later described in FIG. 4*b* includes a grayscale image as a graphic field. The printer using the print head may generate the promotional coupon using the grayscale image thereby improving the look of the promotional coupon when compared to the promotional coupon illustrated in FIG. 4*a* by allowing grayscale images and graphics to be incorporated in a voucher or coupon.

In another example, a grayscale image is used with a promotional coupon or voucher and the media used with such is color thermal media. When the printer generates the grayscale image using the color thermal media, the image may print in multiple shades of the color defined using the color thermal media.

The session escrow area may serve as a means where after one or a plurality of media is printed by a modular gaming transaction printer, such media is held in escrow while waiting for other media to be printed. The printing and storing of media in a session escrow area may occur simultaneously with other functions or processes of the printer such as interfacing and communicating with other devices. The session escrow area may be accessed externally to the printer. For example, in one embodiment, a modular gaming transaction printer may process data related to one or a plurality of promotional coupons and print such coupons at the beginning of a player session such as after the game coupled to the printer transmits to the printer that a cash-in signal was received. Each promotional coupon is stored in the session escrow area until the game transmits to the printer that a cashout signal was received, after which the printer may print a cashout voucher and present to a player the cashout voucher and the one or plurality of promotional coupons from the session escrow area.

In another embodiment, the printer may process and print one or a plurality of promotional coupons anytime during a player session and store each coupon in the session escrow area. Again, after the coupled game transmits to the printer that a cashout signal was received, the printer may print a cashout voucher and present to a player the cashout voucher and each coupon stored in the session escrow area.

In a preferred embodiment, the printing and storing of media in a session escrow area may occur simultaneously with other functions or processes of the printer such as interfacing and communicating with other devices.

Further details of the use of the session escrow area are later disclosed in FIG. 6.

A wireless device interface 112 may serve as the means to interface and communicate with other devices using wireless technology where such interfacing may occur simultaneously with other functions or processes of the printer such as printing. Wireless device technology may include Bluetooth, WiFi, wireless USB, among others. A wireless device may include any wireless device such as PDAs, personal computers, local or wide area networks, handheld devices, routers, gaming machines such as a slot machine, vending machines or kiosks, among others. In one embodiment, the printer includes one or a plurality of wireless device interfaces.

A removable memory device interface may be used as a means to interface with one or a plurality of removable memory devices such as a memory stick or FLASH stick, among others. Each removable memory device may be internal or external to the printer. The interface to such devices includes of a USB interface. In one embodiment, the printer includes one or a plurality of removable memory device interfaces.

In another embodiment, the contents of a removable memory device may include promotional coupon data such as graphics and templates, trigger metrics, promotional campaigns as well as language and font packs, and firmware to upload, among others.

A plurality of paper trays may be used to hold media for use with promotional coupons and cashout vouchers. One tray may be used for the promotional coupon media and another tray for cashout voucher media.

The media for use with the modular gaming transaction printer may be color media which allows information printed on media to print in color, grayscale media which allows information printed on media to print in grayscale, or the one color media that is currently used in gaming and vending applications to print cashout vouchers or promotional coupons.

In one embodiment, one paper tray may be used to hold scrap printed media. For example, instead of presenting to a player a cashout voucher that was voided by the printer, the printer may, after voiding the voucher, return such voucher to another paper tray of the printer.

In another embodiment, a paper tray includes two separate areas where one area may hold promotional coupon media and the other may hold cashout voucher media.

Figure 2:
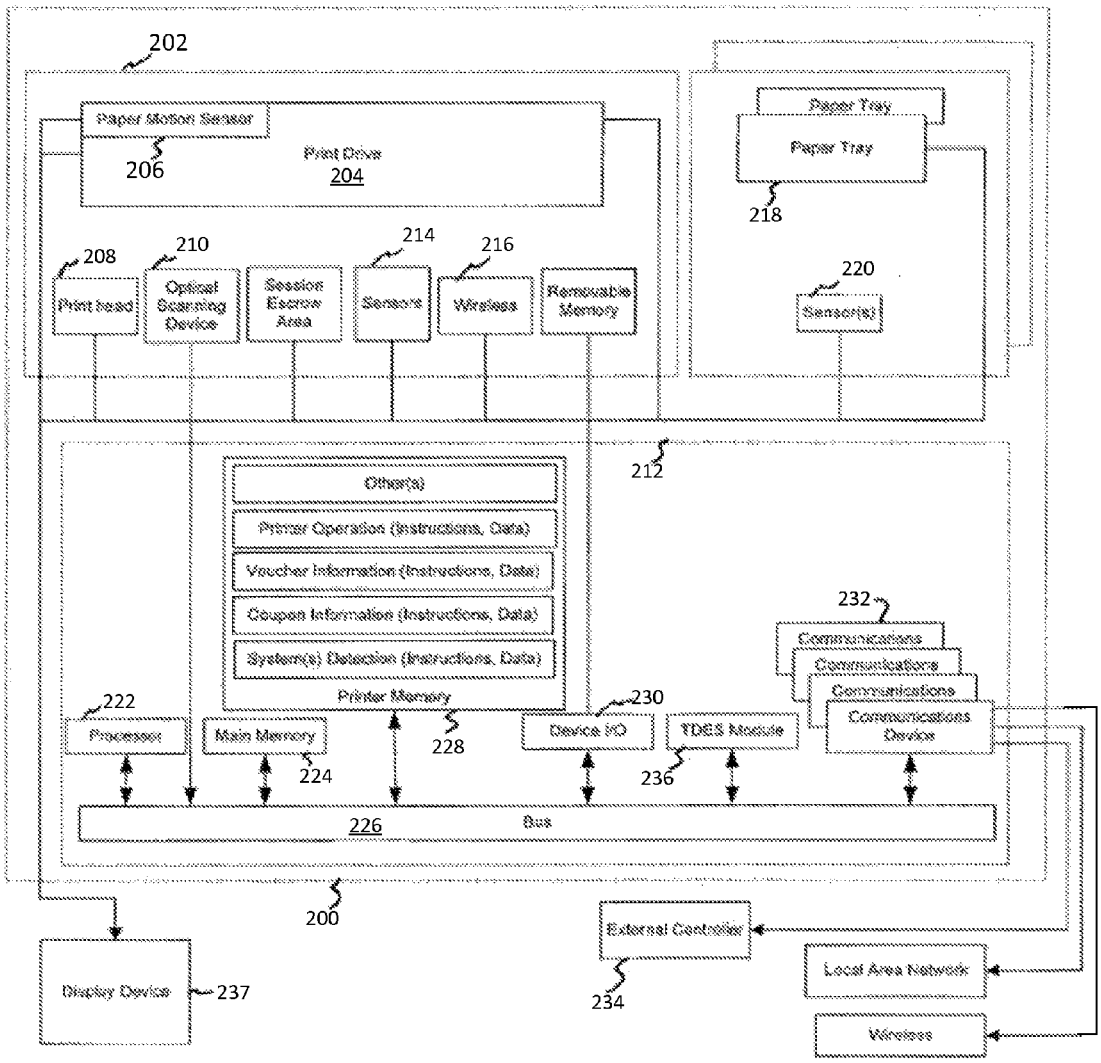
FIG. 2 is a block diagram of a modular gaming transaction printer in accordance with an exemplary embodiment of the present invention.

FIG. 2 is a block diagram of a modular gaming transaction printer 200 in accordance with an exemplary embodiment of the present invention. A component or plurality of components shown in FIG. 2 may be optional.

The print module 202 includes a print drive 204 that moves media such as a cashout voucher or promotional coupon through the print module. The print drive is reversible such that media may be fed through the print module in more than one direction by the print drive. The print drive includes a paper motion sensor 206 for sensing media movement within the print drive. A more detailed discussion of printer media motion detection within a printer is presented in U.S. patent application Ser. No. 10/640,495 entitled "PAPER MOTION DETECTOR IN A GAMING MACHINE", filed Aug. 12, 2003, the contents of which are hereby incorporated by reference as if stated herein in full.

The print module may further include a print head 208 for writing indicia to media such as a cashout voucher or promotional coupon. The print module further includes an optical scanning device 210 for scanning the indicia printed onto media. A modular gaming transaction printer controller 212, hosted by the data processing system, may use the optical scanning device as an interface to receive voucher scan signals from an optical scanning device.

The print module may further include a session escrow area as previously described in FIG. 1.

The print module may further include a sensor interface 214 coupled to the processor via the system bus. A gaming machine printer controller, hosted by the data processing system, uses the sensor interface to receive sensor signals from various components of a printer as previously described.

The print module further may include one or a plurality of interfaces 216 to wireless technology as previously described in FIG. 1. The print module further may include one or a plurality of interfaces to removable memory devices as previously described in FIG. 1.

The print module is removably and electronically coupled to the printer controller and removably and mechanically coupled to one or a plurality of paper trays.

In operation, the print module receives printer control signals from the printer controller. In response to the printer control signals, the print module thermally prints on the media, under the control of the printer controller.

The one or more paper trays 218 store media and provide the media to the printer module on command from the printer controller. In operation, the paper tray receives media control signals from the printer controller. In response to the control signals, the paper tray feeds media to the printer. The paper tray may also include one or more sensors 220 which may be used to detect the media stored in a paper tray.

The printer controller includes a processor 222 coupled to a main memory 224 by a system bus 226. The printer controller also includes a printer memory 228 coupled to the processor by the system bus, the printer memory comprising the firmware for system detection, printer operation, voucher information, coupon information, and others.

The printer memory, either internal and/or external, may consist of such common devices as RAM, EPROM, EEPROM, FLASH Chips, magnetic storage devices such as floppy or hard drivers, Flash Sticks and other storage media commonly used in the computer industry. The printer memory includes a plurality of memory sections that may be independently addressed for both content read and content write operations. A printer operation section is included for storage of programming instruction codes and printer data used by the processor to operate the printer. The execution of these codes determines the conditions under which voucher information, including voucher generation instructions and voucher data included in a voucher information section are utilized to generate a gaming voucher. A coupon information section included in the printer memory holds coupon generation instructions and coupon data used by the printer to generate a promotional coupon.

The system detection section of the printer memory may be used by the printer to configure itself after power up to perform gaming voucher printing, promotional coupon printing, or a combination thereof based on the system or plurality of systems detected. The system detection section may also detect whether the printer is operating in a cashless enabled game or gaming table within a gaming system, a promotional system, or a combination thereof without recycling the power to the printer. Upon detection of a gaming system, the system detection section of the printer memory may then interact with the printer operation section and voucher information section of the printer memory to allow the printer to generate gaming vouchers. Upon detection of a promotional system, the system detection section of the printer memory may then interact with the printer operation section and coupon information section of the printer memory to allow the printer to generate promotional coupons. Upon detection of dual systems of both gaming and promotional systems, the system detection section of the printer memory may then interact with the printer operation section, the voucher information section, and the coupon information section of the printer memory to allow the printer to function with a cashless enabled game or gaming table to generate gaming vouchers and, if necessary or available, promotional coupons.

Generally, the contents of the printer operation section are not changed frequently. The contents of the voucher information section describe the format of the information that is printed on a gaming voucher. Contents of the voucher information section are changed rarely. The coupon information section includes the data that describes the format of the information that is printed on a promotional coupon. The contents of the coupon information section are changed frequently. The contents of system detection section are changed rarely.

The partitioning of the memory into separate code and data sections allows separate digital signatures to be maintained for each section. A signature, as an example a mathematical formula, may be generated for the memory content of a first section, such as the printer operation content, independently of all other memory sections. A second signature, again as an example of a mathematical formula, may be generated for a second memory section, such as the voucher data section, independently of all other memory sections. A third signature, again as an example of a mathematical formula, may be generated on a third memory section, such as the coupon section, independently of all other memory sections. The signatures provide an identifier that is statistically unique in describing the contents of each memory section. A fourth signature, again as an example of a mathematical formula, may be generated on a fourth memory section, such as the systems detection section, independently of all other memory sections. In addition, a signature may be generated for all the memory sections combined.

In practical use, the sectioned printer memory allows the contents of the second section and/or third section to be viewed individually and separately from the contents of the first section. The mathematical formula is used to generate the statistically unique identifier or signature of the printer to confirm whether or not the memory content has changes, through alteration of the programming instruction codes or by other means.

The second section and third section may contain the content of the printed image of a gaming voucher and a promotional coupon, respectively. For example, in the case of a promotional coupon, a gaming establishment operator may want to change the image and contents of the promotional coupon frequently. In this case, the gaming establishment may then change just the third section of memory including the coupon data without disturbing the first section of memory. The conditions that cause the gaming voucher and/or promotional coupon to be printed are controlled by the cashless enabled game or gaming table in accordance with the programming instruction codes and the coupon data.

The printer controller also includes an Input/Output (I/O) 230 device coupled to the processor by the system bus. The I/O device is used by the printer controller to transmit control signals to the print module and each paper tray. The I/O device may also be used by the printer controller to receive security feature and status signals from the print module and each paper tray.

One or more communications devices 232 may be coupled to the system bus for use by the printer controller to communicate with a cashless gaming system host or a game controller. The printer controller uses the communication devices to receive commands, program instructions, and other information from the external devices such as gaming machines, etc. In addition, the printer controller may use the communication devices to transmit printer status information to the external devices. Other communication devices may also be used by the printer controller to couple in a secure fashion over a local area network either a hard link or wireless or both for administrative or other purposes.

Additional communication devices and channels may be provided for communication with other peripheral devices as needed. For example, one communication device may be provided with a local communications port, accessible from an exterior of a gaming machine hosting the multi-media printer that a technician may use to communicate with the printer controller during servicing using an external controller 234. The external controller may communicate with the printer controller using Bluetooth, WiFi, infrared link, other short-range wireless communication link, or a hard link with an external connector in a secure manner.

The processor may be further coupled to an encryption/decryption module 236 that may be used to encrypt and decrypt messages encoded using an encryption standard. This enables the printer controller to engage in secure transactions with external devices. The processor may access the encryption/decryption module either as a component through the bus as shown or as an external device through a communications device using a high level communications protocol. In addition, the printer controller may also include program instructions to perform encryption/decryption services as well.

The processor may be further coupled to a display device 237 that may be used to display printer status information or media information. The processor may access the display device either as a component through the I/O device or as an external device through a communications device.

In operation, the processor loads the programming instructions into the main memory and executes the programming instructions to implement the features of the printer as described herein.

As illustrated, the printer controller is shown as being electronically coupled to the print module and one or more paper trays without any mechanically coupling. The printer controller may be mounted in a variety of ways and may be incorporated into various components of either the printer or the game hosting the printer. For example, the printer controller may be attached to and supported by the print module, one or more paper trays, or the host game as may be required to mechanically integrate the printer into the host game.

Figure 3A:
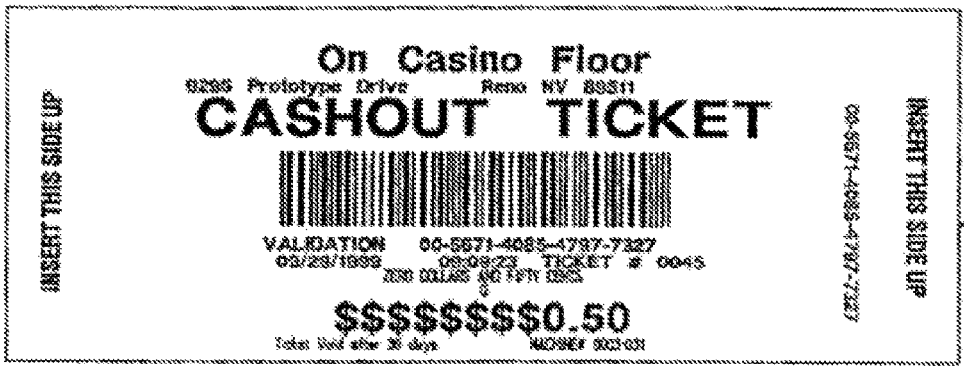
FIG. 3*a* is an illustration of a cashout voucher used currently used in a gaming environment in accordance with an exemplary embodiment of the present invention.

FIG. 3*a* is an illustration of a cashout voucher 300 used currently used in a gaming environment in accordance with an exemplary embodiment of the present invention.

The voucher shown is produced from commands issued by the cashless enabled game to a cashless gaming printer in response to a player's request to cash-out. The voucher includes features such as a validation number, printed in both a human readable fowl such as a character string and in a machine-readable form such as a bar code, time and date stamps, cash-out amount, casino location information, cashless enabled game identifier, and an indication of an expiration date.

Figure 3B:
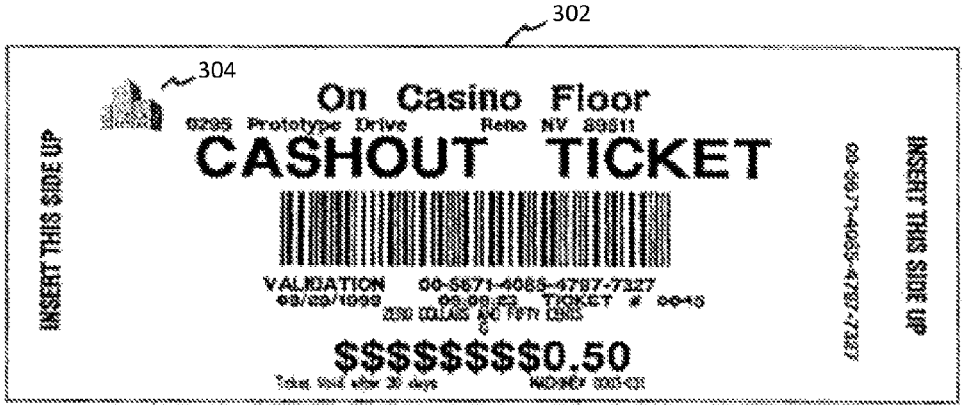
FIG. 3*b* is an illustration of a grayscale cashout voucher for use in a gaming environment in accordance with an exemplary embodiment of the present invention.

FIG. 3*b* is an illustration of a grayscale cashout voucher 302 for use in a gaming environment in accordance with an exemplary embodiment of the present invention.

This figure includes the same features as the voucher described in FIG. 3*a*. However, FIG. 3*b* includes a grayscale logo 304 which is generated using the grayscale printing capabilities of the modular gaming transaction printer. Additionally, if the media used with the cashout voucher is color media, the grayscale logo may be set to print in multiples shades of the color set in the media.

Figure 4A:
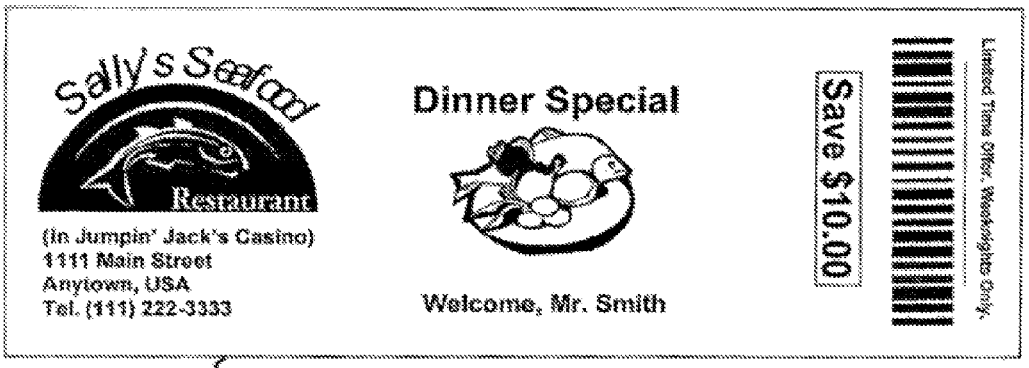
FIG. 4*a* is an illustration of a promotional coupon in accordance with an exemplary embodiment of the present invention.

FIG. 4*a* is an illustration of a promotional coupon 400 in accordance with an exemplary embodiment of the present invention.

In this example, a coupon may include four types of data fields: text fields, such as text field; barcode fields, such as barcode field; graphic fields, such as graphic field; and line/box draw fields, such as line/box draw field.

In this illustration, the graphic fields are one color images such as a black and white images.

Figure 4B:
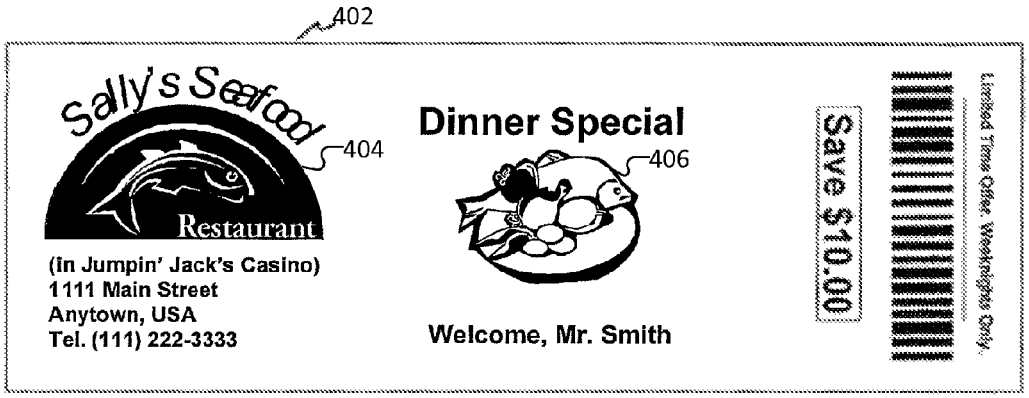
FIG. 4*b* is an illustration of a grayscale promotional coupon in accordance with an exemplary embodiment of the present invention.

FIG. 4*b* is an illustration of a grayscale promotional coupon 402 in accordance with an exemplary embodiment of the present invention.

This figure includes the same features as the coupon described in FIG. 4*a*. However, FIG. 4*b* uses as the graphic field a grayscale logo 404 and grayscale graphic 406 which may be generated using the grayscale printing capabilities of the modular gaming transaction printer. Similar to a cashout voucher, if the media used with a promotional coupon is color media, the grayscale logo and grayscale graphic may be set to print in multiples shades of the color set in the media.

In one embodiment, the media for a promotional coupon is color media.

Figure 5A:
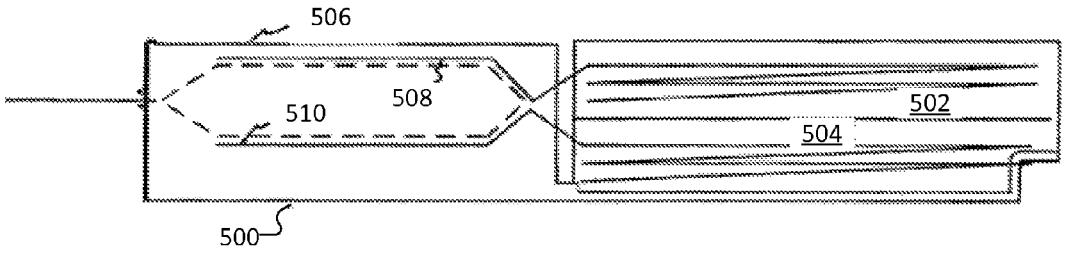
FIG. 5*a* is an illustration of media in a plurality of paper trays utilizing a session escrow area in accordance with an exemplary embodiment of the present invention.

FIG. 5*a* is an illustration of media in a plurality of paper trays utilizing a session escrow area in accordance with an exemplary embodiment of the present invention.

As illustrated, the printer 500 includes a plurality of paper trays, 502 and 504, horizontally stacked. Each tray may hold media such as color media or any other media as previously described or known in the art. The printer also includes a print module 506 which may include a session escrow area as previously described in FIG. 1. The print module may also include a plurality of paper paths such as paper path 508 and paper path 510, a paper routing mechanism, a paper retrieval mechanism, and a paper exit.

In operation, after receiving a cashout signal, the printer may pull media from one of the paper trays, such as the bottom paper tray to generate a cashout voucher. The voucher is printed and pulled past a paper routing mechanism, where the routing mechanism may be used to direct the cashout voucher using paper path 508, after which the cashout voucher is dispensed from the printer using the paper exit.

After receiving a signal to print one or a plurality of promotional coupons, the printer may pull media from one of the paper trays, such as the top paper tray to generate each coupon. The coupon is printed and pulled past a paper routing mechanism, where the routing mechanism may be used to direct the coupon to a session escrow area using paper path 510, where the coupon may stay pending the receipt of a cashout signal, after which the coupon or plurality of such is dispensed with a cashout voucher, if any using the paper exit.

Should a paper jam or any other error occur, or if the paper must be retracted into the printer, a paper retrieval mechanism may be used.

In a variation, the printer includes one paper tray holding media which is used for printing both cashout vouchers and promotional coupons. In this embodiment, media is pulled and routed through either the first paper path or the second paper path, depending on the type of print job, such as promotional coupon or cashout voucher.

Figure 5B:
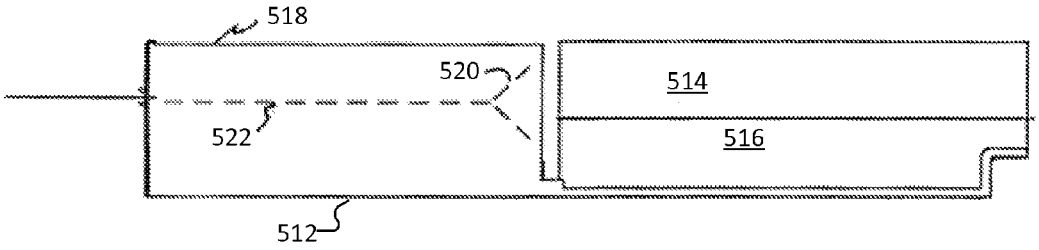
FIG. 5*b* is an illustration of a plurality of paper trays utilizing one paper path in accordance with an exemplary embodiment of the present invention.

FIG. 5*b* is an illustration of a plurality of paper trays utilizing one paper path in accordance with an exemplary embodiment of the present invention.

As illustrated, the printer 512 includes a plurality of paper trays, 514 and 516, horizontally stacked. Each tray may hold media such as color media or any other media as previously described or known in the art. The printer also includes a print module 518, a paper routing mechanism 520, one paper path 522, and a paper exit.

The operations of the printer 512 are similar to that of printer 500 as described in FIG. 5*a*.

In a variation, one tray may be used to hold scrap media. In this embodiment, should a paper jam or any other error occur, or if the paper must be retracted into the printer, the paper routing mechanism is used as a paper retrieval mechanism to pull the media into the scrap paper tray.

Figure 6:
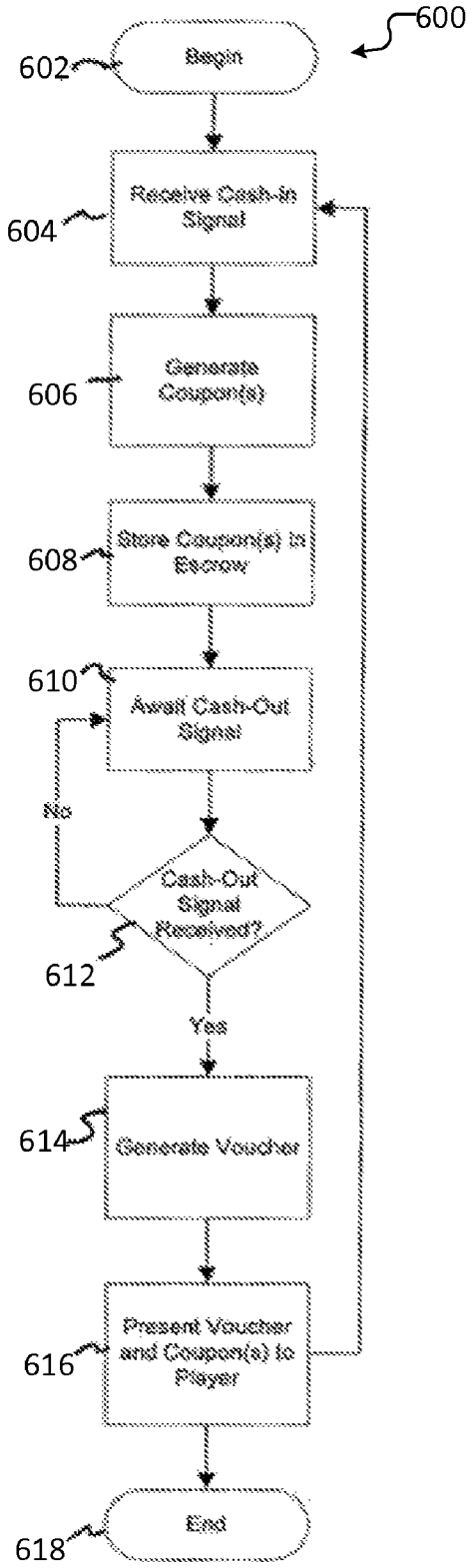
FIG. 6 is a block diagram of the session escrow process for one or a plurality of promotional coupons in accordance with an exemplary embodiment of the present invention.

FIG. 6 is a block diagram of the session escrow process for one or a plurality of promotional coupons in accordance with an exemplary embodiment of the present invention.

As illustrated, the process 600 begins (602) with a cash-in signal being received (604) for a player. The cash-in signal may be transmitted by a host system such as a game to the printer. At any time after the printer receives the signal, the printer may generate (606) one or a plurality of promotional coupons, after which each printed coupon is stored (608) in the session escrow area previously described in FIG. 1 and FIG. 2. The process continues with the printer awaiting (610) a cash-out signal, which may be transmitted by a host system such as a game to the printer.

If the printer receives (612) a cash-out signal, the printer may generate (614) a cash-out voucher after which the voucher and each promotional coupon stored in the session escrow area are presented (616) to the player. Thereafter, the process may end (618) or loop back to receive cash-in signal for the real-time monitoring of signals such as a cash-in signal.

In one embodiment, a modular gaming transaction printer may process data related to one or a plurality of promotional coupons and print such coupons at the beginning of a player session such as after the game coupled to the printer transmits to the printer that a cash-in signal was received. Each promotional coupon is stored in the session escrow area until the game transmits to the printer that a cashout signal was received, after which the printer may print a cashout voucher and present to a player the cashout voucher and the one or plurality of promotional coupons from the session escrow area.

In another embodiment, the printer may process and print one or a plurality of promotional coupons anytime during a player session and store each coupon in the session escrow area. Again, after the coupled game transmits to the printer that a cashout signal was received, the printer may print a cashout voucher and present to a player the cashout voucher and each coupon stored in the session escrow area.

In one embodiment, the printing and storing of media in a session escrow area may occur simultaneously with other functions or processes of the printer such as interfacing and communicating with other devices.

Figure 7:
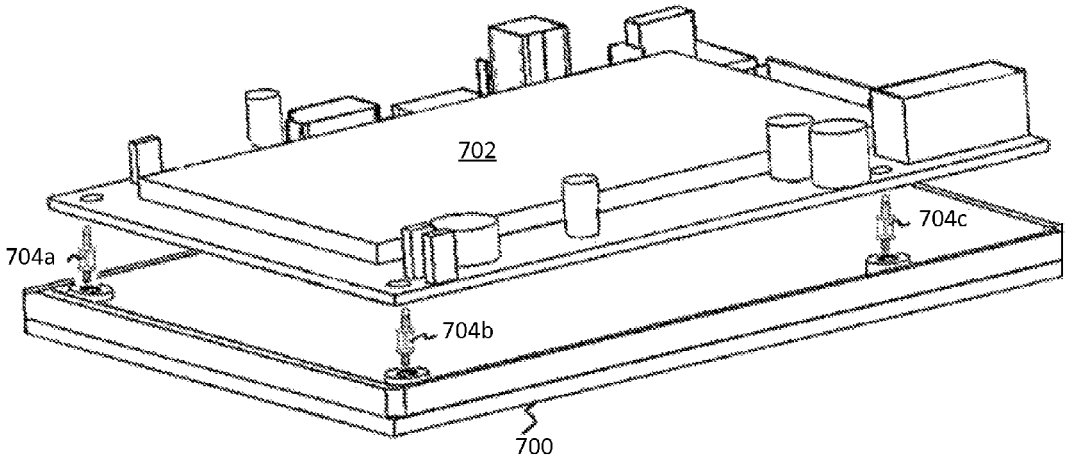
FIG. 7 is an illustration of the snap-in mount of a component of a modular gaming transaction printer in accordance with an exemplary embodiment of the present invention.

FIG. 7 is an illustration of the snap-in mount of a component of a modular gaming transaction printer in accordance with an exemplary embodiment of the present invention.

Illustrated is the lower portion 700 of the casing of a printer, an electronics board 702, and a plurality of fasteners 704*a*, 704*b* and 704*c*. The fasteners permit the snap-in retention or snap mount of one or a plurality of boards and/or components to ease servicing and/or replacement of boards and/or components. The fasteners includes a screw-in type on one end with a locking mechanism on the other end or a locking mechanism on both ends, among others.

In another embodiment, the snap-in mount of one or a plurality of paper trays to the printer may use the same or similar mechanism.

Figure 8:
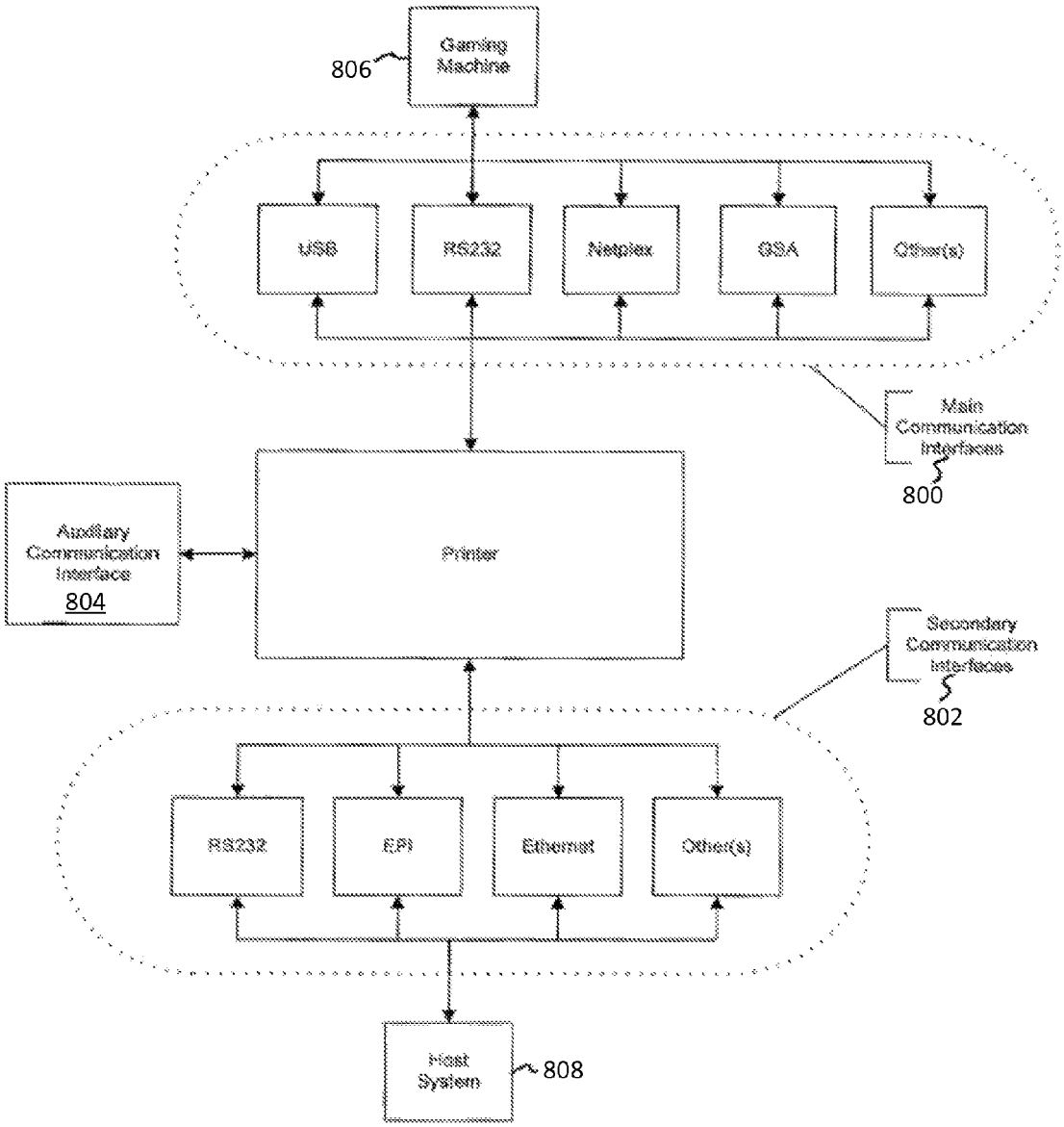
FIG. 8 an illustration of the various interfaces to which a modular gaming transaction printer may connect in accordance with an exemplary embodiment of the present invention.

FIG. 8 an illustration of the various interfaces to which a modular gaming transaction printer may connect in accordance with an exemplary embodiment of the present invention.

The printer may be coupled to three communication interfaces illustrated as main communication interface 800, secondary communication interface 802, and auxiliary communication interface 804. The main communication interface may provide a connection with one or a plurality of gaming machine interfaces or protocols such as USB, RS232, Netplex, GSA, or Other(s).

The main communication interface may consist of a singular physical connection. In this case, the printer has the means to monitor the physical layer of the gaming machine 806 and the protocol layer of the gaming machine, to automatically adjust to the physical and protocol layers of the gaming machine and begin communications with the gaming machine.

The secondary communication interface may provide a connection with one or a plurality of host system interface or protocols such as RS232, EPI, Ethernet, or Other(s).

The secondary communication interface may consist of a singular physical connection. In this case, the printer has the means to monitor the physical layer of the host and the protocol layer of the host 808, to automatically adjust to the physical and protocol layers of the host and begin communications with the host.

The auxiliary communication interface may provide a connection to external devices such as a host system, reference printer, or handheld device.

In a preferred embodiment, the printer may simultaneously interface with a plurality of host systems. Additionally, the printer may automatically detect and connect to different host systems and gaming machine protocols.

Figure 9:
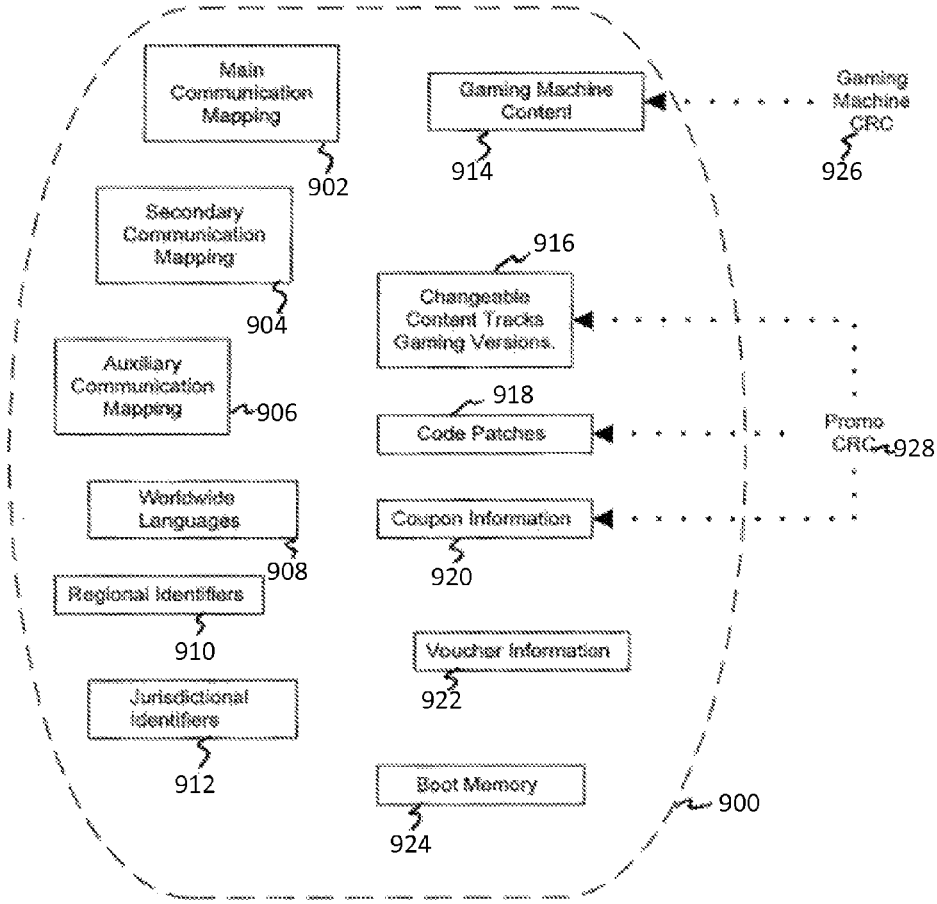
FIG. 9 is an illustration of the segmented memory and memory map of the modular gaming transaction printer in accordance with an exemplary embodiment of the present invention.

FIG. 9 is an illustration of the segmented memory and memory map of the modular gaming transaction printer in accordance with an exemplary embodiment of the present invention.

The segmented memory 900 includes all memory content previously disclosed in FIG. 2. Additionally, the memory may include areas for main communication mapping 902, secondary communication mapping 904, auxiliary communication mapping 906, worldwide languages 908, regional identifiers 910, jurisdictional identifiers 912, gaming machine content 914, changeable content tracking gaming versions 916, code patches 918, coupon information 920, voucher information 922, and boot memory 924.

The main communication mapping area of the printer memory may be used for mapping to a gaming machine. Contents for mapping may include among others the currently active gaming machine interface, mapping to ticket files, mapping to coupon files, and gaming machine implementation information. Additionally, the main communication mapping area of the printer memory may be used for downloading capabilities for gaming machine application code, gaming machine application code patches, gaming machine templates, promotional codes, promotional templates, promotional code patches, configuration to one or multiple worldwide languages, regions, or jurisdictions, configuration to one or multiple protocols as later disclosed in FIG. 14, configuration to prior firmware versions, and printer maintenance functions. The main communication mapping area may also include processes which allow for print arbitration awareness and additional communication interface awareness.

The secondary communication mapping area of the printer memory may be used for mapping to a host system, a plurality of host systems, and or a gaming machine. Contents for mapping may include among others the currently active host system, plurality of host systems, or gaming machine interface, mapping to ticket files, mapping to coupon files, and host system or systems implementation information. Additionally, the secondary communication mapping area of the printer memory may be used for downloading capabilities for application code from a host system, a plurality of host systems, or a gaming machine, application code patches from a host system, a plurality of host systems, or a gaming machine, promotional codes, promotional templates, promotional code patches, configuration to one or multiple worldwide languages, regions, or jurisdictions, configuration to one or multiple protocols as later disclosed in FIG. 14, configuration to prior firmware versions, and printer maintenance functions. The secondary communication mapping area may also include processes which allow for print arbitration awareness and additional communication interface awareness.

The auxiliary communication mapping area of the printer memory may be used for mapping to an external device. Contents for mapping may include among others printer maintenance functions as well as downloading capabilities for gaming machine application code, gaming machine application code patches, gaming machine templates, promotional codes, promotional templates, promotional code patches, configuration to one or multiple worldwide languages, regions, or jurisdictions, configuration to one or multiple protocols as later disclosed in FIG. 14, and configuration to prior firmware versions. Additionally, the auxiliary communication mapping area of the printer memory may include processes which allow for print arbitration awareness and additional communication interface awareness.

The worldwide languages area of the printer memory may be used to support configuration to languages used worldwide, such as Korean, German, and Japanese as well as the ability to detect which language is in use and identify the worldwide language using a unique identifier.

The regional identifiers area of the printer memory may be used to support worldwide regional requirements by gaming regulators and other regulating agencies, such as a unique identifier for each region.

The jurisdictional identifiers area of the printer memory may be used to support worldwide jurisdictional requirements by gaming regulators and other regulating agencies, such as a unique identifier for each jurisdiction.

Data from the worldwide languages area, the regional identifiers area, and the jurisdictional identifiers area, among others, may be used in the location code storage layer as later disclosed in FIG. 14.

The gaming machine content area of the printer memory may be used for information related to the gaming machine such as gaming machine implementation information and a table identifying each gaming machine application code patch. Additional information in this area of the printer memory may include mapping to specific gaming machine regions, gaming machine templates, a specific ticket file, and a specific coupon file. This area may be used to create a gaming machine CRC signature 926.

The changeable content tracks gaming versions area of the printer memory may be used for information related to content which may be modified in gaming machines versions such as all print regions, all ticket files, all coupon files, and any tables containing conversion data for worldwide configuration.

The code patches area of the printer memory may be used to create a link between gaming machine code patch table from the gaming machine content area and the promotional code patch table from the coupon information area.

The coupon information area of the printer memory may be used for information related to promotions such as promotion implementation information, a table identifying each promotion code patch, and instructions and data as previously disclosed in FIG. 2.

The voucher information area of the printer memory may be used for information related to gaming vouchers such as instructions and data as previously disclosed in FIG. 2.

The changeable contents tracks gaming versions, code patches, and coupon information areas of the printer memory may be used to create a promotional CRC signature 928.

The boot memory may be used for processes and other information related to modular gaming transaction printer during power up or when the power is recycled, among others.

In one embodiment, the fields of a gaming voucher or promotional coupon may be described using description data included in an electronic template that may be stored by a printer in the printer memory such as in the gaming machine content area, the coupon information area, or the voucher information area. These fields may include a barcode field, text field, a graphic field, and line/box draw field. A template may include a plurality of these fields in combination, resulting in a paste-up style printed gaming voucher or promotional coupon. A plurality of templates describing different types of gaming vouchers may be stored in the voucher information section of the printer memory to be used by the printer to support the gaming operations of a gaming establishment. Similarly, a plurality of templates describing different types of promotional coupons may be stored in the coupon information section of the printer memory to be used by the printer to support the promotional operations of a gaming establishment.

The actual value or data for each of the fields described in a template may or may not be included in the template itself. Instead, the template may include instructions on how to generate a gaming voucher or promotional coupon but may not include the actual data printed onto the gaming voucher or promotional coupon. For example, a template may include a barcode field for printing a barcode. However, the actual value of the barcode is transmitted to a printer from a host system at the time a gaming voucher or promotional coupon is generated using the template. In this way, a gaming voucher or promotional coupon may have fields that include static data, such as a logo in a graphic field, or dynamic data, such as the name of a patron in a text field. In this way, customized gaming vouchers or promotional coupons may be printed by a printer without transferring large amounts of data through a communications device.

A template may include a plurality of command strings. Each command string may conform to the following example syntax:

```
delimiter<cmd_Ltr>|<data_field1>|....|<data_fieldx>|delimiter;comment
where:
    delimiter = a delimiter character
    <cmd_Ltr> = command identifier letter
    | = pipe character. This serves as the delimiter between data fields in a command.
    <data_field1 – x > fields which include information relative to the command.
    ; semi-colon. This is a comment field designator.
    comment = any comments.
A template may adhere to the following syntax:
    delimiter<template_cmd_Ltr>|<t_id>|<targ_mem>|<t_dim_da>|<t_dim_pa>|
    <pr#1>|<pr#2>|...|<pr#n>|delimiter
where
    <t_id> = the template I.D.
    <targ_mem> = target memory storage.
    <t_dim_da> = template dimension on a dotline axis in dots.
    <t_dim_pa> = template dimension in dots in the paper axis.
    <pr#l>...<pr#n> = list of gaming vouchers or promotional coupon data resident
    print regions IDs used in the format of the gaming voucher or promotional
    coupon. These fields are the method by which print regions used on a gaming
    voucher or promotional coupon are linked together and to the template.
```

A print region is a print field used in a template to format print data. The print region command is used to define the basic types of print regions such as text, barcode, graphics, and line/box draw.

A define print region command defines the particular font, barcode, graphic, or line style which is to be used, and provides special formatting information on how it is to be used. Multiple print regions may be defined and memorized in a printer's sectioned memory.

As an example, the host system may transmit gaming voucher data or promotional coupon data to the printer to generate a gaming voucher or promotional coupon, respectively. To further describe, the host system may also include a reference to a template definition so that the dynamic data transmitted by the host system can be combined with the static data stored in the printer to generate a complete gaming voucher or promotional coupon depending on the host system. Additionally, since it is possible to store all the fields used on a gaming voucher or promotional coupon with the printer memory, a host system may issue a complete gaming voucher or promotional coupon by simply sending a reference to a gaming voucher or promotional coupon stored in the printer memory to generate the gaming voucher or promotional coupon in its entirety.

In another embodiment, the fields of a gaming voucher or promotional coupon and instructions on how to generate a gaming voucher or promotional coupon may be used without an electronic template for the generation of a gaming voucher or promotional coupon. The fields may include any or all those previously described.

Figure 10:
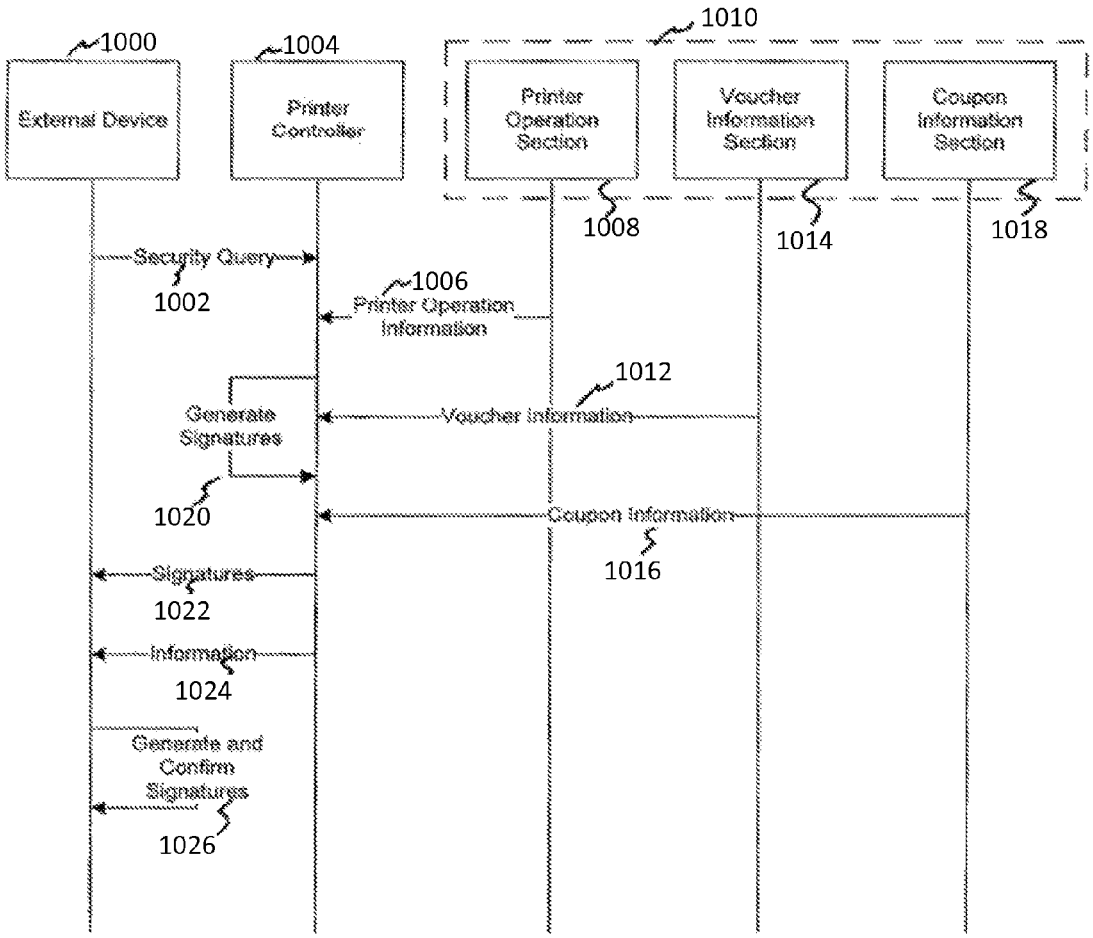
FIG. 10 is a sequence diagram of a process for confirming the contents of the section printer memory in accordance with an exemplary embodiment of the present invention.

FIG. 10 is a sequence diagram of a process for confirming the contents of the section printer memory in accordance with an exemplary embodiment of the present invention.

An external device 1000, such as a host system, reference printer, or handheld device may transmit a security request 1002 to a printer controller 1004. In response to the security request, the printer controller may read printer operation information 1006 from the printer operation section 1008 of the printer memory 1010. The printer controller may also read voucher information 1012 from the voucher information section 1014 and coupon information 1016 from the coupon information section 1018. The printer controller may then generate (1020) individual signatures for each of the memory sections and a total signature for the printer memory. The signatures (1022) may then be transmitted to the external device for further processing.

Alternatively, the printer controller may transmit all or part of the read information 1024 to the external device. The external device then may generate (1026) individual or total signatures for the transmitted information to confirm the contents of the printer memory.

Figure 11:
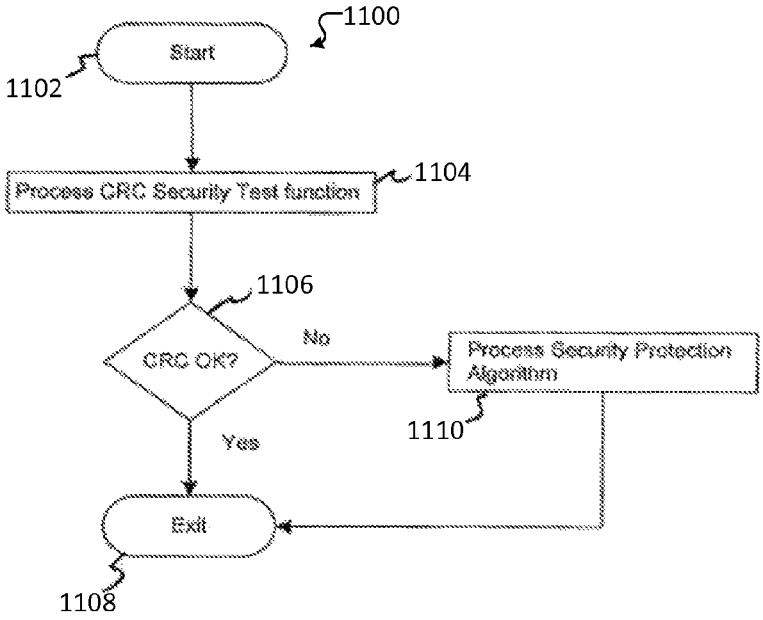
FIG. 11 is a diagram of a security test performed on the memory of the modular gaming transaction printer in accordance with an exemplary embodiment of the present invention.

FIG. 11 is a diagram of a security test performed on the memory of the modular gaming transaction printer in accordance with an exemplary embodiment of the present invention.

As illustrated, the process 1100 begins (1102) with the processing (1104) of the CRC security test. If the CRC is verified (1106) and the contents or code has not changed, the process ends (1108). Otherwise, the security protection algorithm is processed (1110).

An example security protection algorithm may perform all of the following checks to determine the validity of memory contents of the modular gaming transaction printer: a security check on the gaming machine CRC, promotional CRC, boot memory, and any code patches. If at any time, a function of the algorithm fails, an error report may be returned to a host system and printer functions may be halted.

Figure 12:
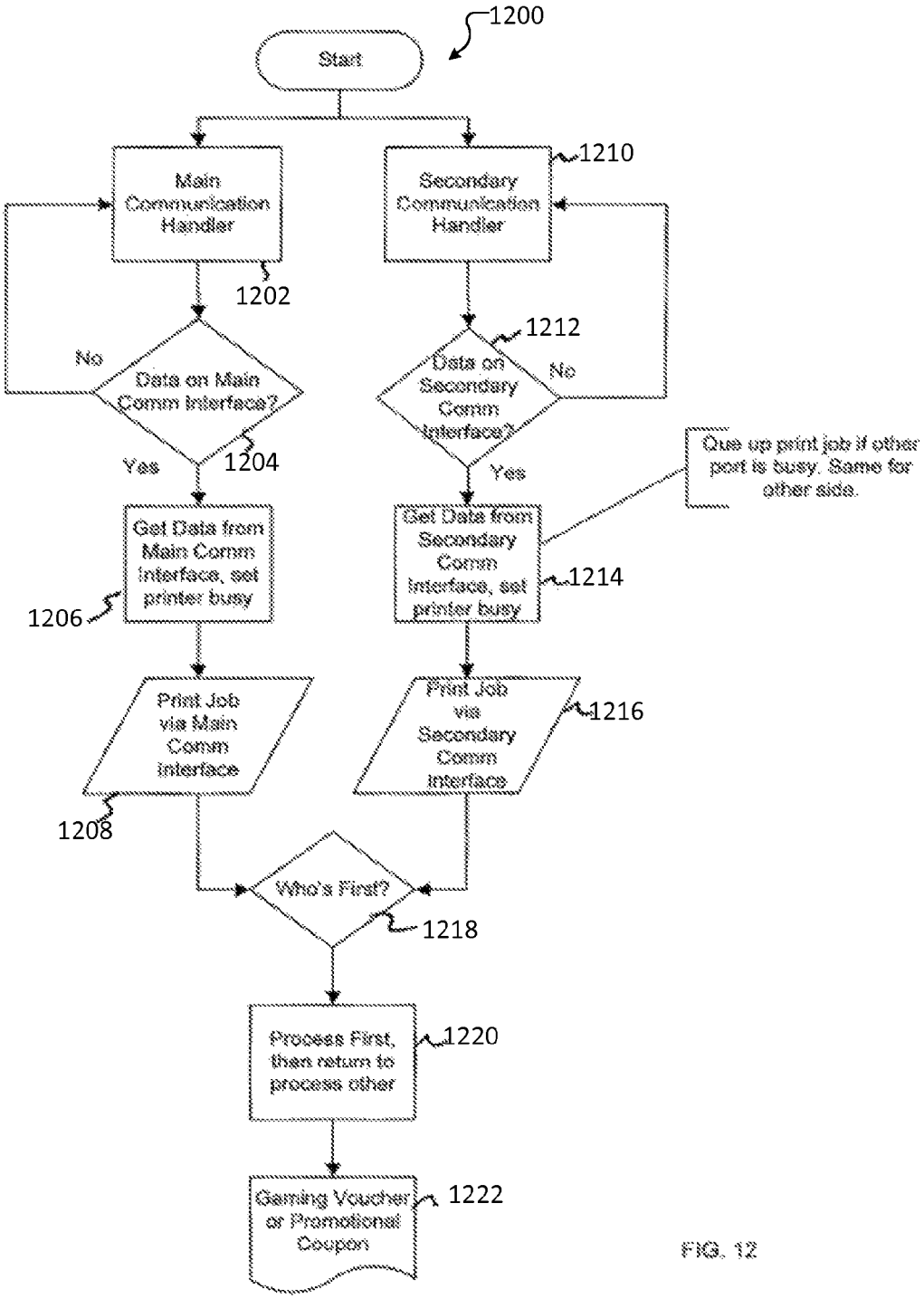
FIG. 12 is an illustration of print arbitration process of the modular gaming transaction printer in accordance with an exemplary embodiment of the present invention.

FIG. 12 is an illustration of print arbitration process 1200 of the modular gaming transaction printer in accordance with an exemplary embodiment of the present invention.

As illustrated, the process for the main communication interface begins with the Main Communication Handler 1202. If data such as a gaming voucher exists (1204) on the main communication interface, the system gets (1206) the data 1208 from the main communication interface and sets the printer to busy. If data does not exist on the main communication interface, the process returns to the Main Communication Handler.

The process for the secondary communication interface begins with the Secondary Communication Handler 1210. If data such as a promotional coupon exists (1212) on the secondary communication interface, the system gets (1214) the data 1216 from the secondary communication interface and sets the printer to busy. If data does not exist on the secondary communication interface, the process returns to the Secondary Communication Handler.

If the printer is busy using any communication interface, the data from the other communication interface is queued.

The process continues with the system identifying 1218 which data was received first. After identifying the data received first, the system processes 1220 the first data to generate for instance a gaming voucher or promotional coupon, then returns to process the second data to generate for instance a gaming voucher or promotional coupon 1222.

An example of one arbitration scheme would be the modular gaming transaction printer always giving priority to a gaming voucher print job which comes from the gaming machine (on the main communication interface), and then queuing a coupon print job (on the secondary communication interface) behind the gaming voucher. Another example of an arbitration scheme would be the modular gaming transaction printer receiving a coupon print job on its secondary communication interface, then holding the coupon for a period of time awaiting arrival of a gaming voucher on the main communication interface. If the gaming voucher did not arrive within a reasonable amount of time, the coupon could either be printed or canceled by the printer. In addition to coupon print data, the printer would receive certain static promotional campaign data on its secondary communication interface. The static data could include graphic icons which are necessary to print on the various coupons, portions of the coupons which would never change with an award, and optionally, a set of trigger conditions which would cause the printer to trigger a coupon.

Figure 13:
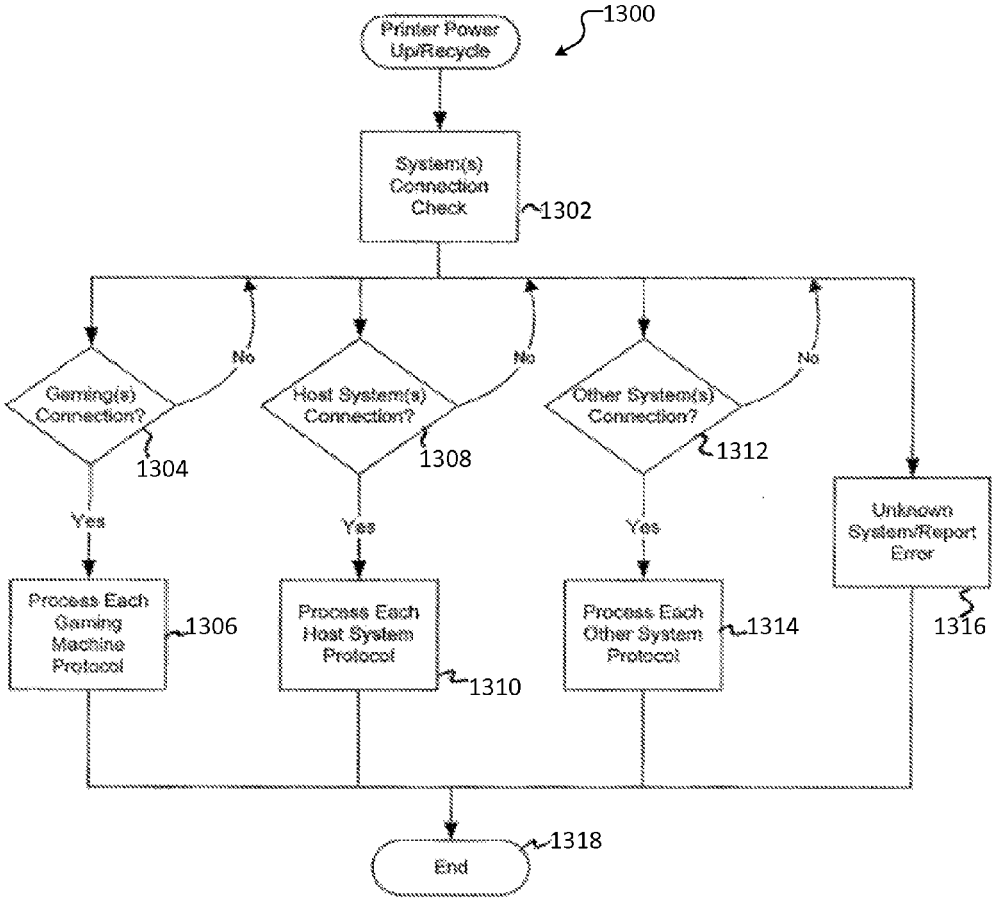
FIG. 13 is a diagram of a system connection check process used by the printer in accordance with an exemplary embodiment of the present invention.

FIG. 13 is a diagram of a system connection check process used by the printer in accordance with an exemplary embodiment of the present invention.

As illustrated, the process 1300 begins with the printer power up or recycle, after which a system connection check is performed (1302) to establish communication with one or a plurality of gaming machines, one or a plurality of host systems, and one or a plurality of other systems. During the system connection check, the printer may detect (1304) that it is connected to one or a plurality of gaming machines, whereby the process continues with processing (1306) each gaming machine protocol.

Also during the system connection check, the printer may detect (1308) that it is connected to one or a plurality of host systems, whereby the process continues with processing (1310) the protocol of each host system.

Also during the system connection check, the printer may detect (1312) that it is connected to one or a plurality of other systems, whereby the process continues with processing (1314) the protocol of each of the other systems.

Also during the system connection check, the printer may not detect a connection or may detect an unknown connection (1316), whereby the process continues with an unknown system report or error being generated and may be returned to a host system. Additionally, printer functionality may be halted.

This system connection check may process in a continual loop whereby once a detection is made, the process continues by checking for other connections. The process ends (1318) when no further connections are detected.

Additionally, a system connection check may be used to detect a new connection made to or from the modular gaming transaction printer. In this embodiment, when a connection is detected to one or a plurality of systems or gaming machines, the protocol for each new connection is processed and the previously detected protocol may be disconnected. For example, the modular gaming transaction printer is connected to a gaming machine protocol of RS232. The printer is removed from the gaming machine and placed in a gaming machine using a protocol of Netplex or USB. Accordingly, the system connection check may disconnect communication with the RS232 protocol and process the Netplex or USB protocol.

In one embodiment, the modular gaming transaction printer will automatically detect and connect to a plurality of host and gaming machine protocols.

In another embodiment, after performing a system connection check, the modular gaming transaction printer may simultaneously interface with multiple protocols, whereby the protocols may include one or a plurality of gaming machines, one or a plurality of host systems, one or a plurality of other systems, or a combination of any.

Figure 14:
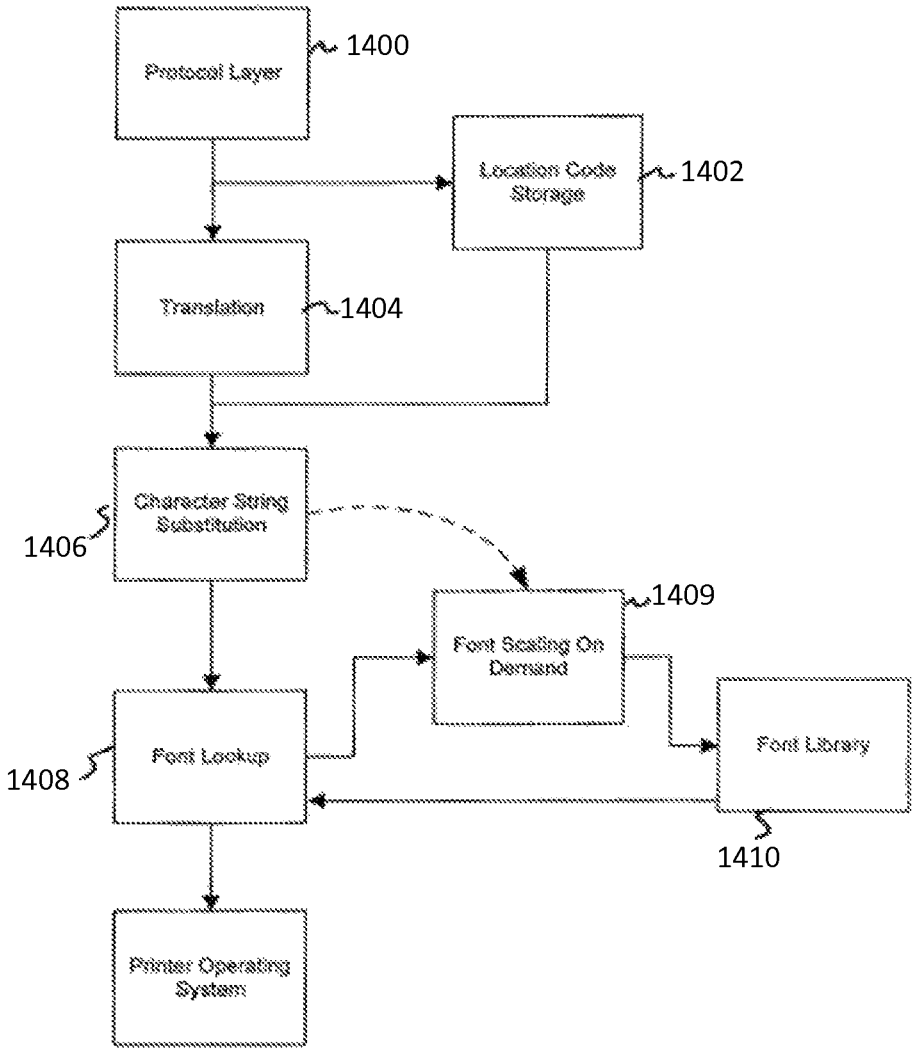
FIG. 14 is a diagram illustrating various layers of data from a protocol to the printer in accordance with an exemplary embodiment of the present invention.

FIG. 14 is a diagram illustrating various layers of data from a protocol to the printer in accordance with an exemplary embodiment of the present invention.

In one embodiment, the printer operating system may be coupled to a plurality of data layers such as a protocol layer 1400, location code storage 1402, a translation layer 1404, a character string substitution layer 1406, and a font lookup layer 1408. Ideally, data may be derived from all layers to permit the printer to properly function within any worldwide region using any protocol with the ability to generate gaming vouchers, promotional coupons, and other printed items of interest using any worldwide language. Additionally, any or all data layers may reside in the memory of the printer as previously disclosed in FIG. 2 and FIG. 9.

The protocol layer may include all necessary information to connect with a communication interface. In a preferred embodiment, there may exist a plurality of protocol layers, such as USB, Netplex, and RS232, among others, each protocol comprising a unique identifier.

The location code storage layer may include information relevant to one or a plurality of countries, one or a plurality of jurisdictions, one or a plurality of regions, and one or a plurality of properties belonging to a Gaming Establishment. Each location code may include a unique identifier for each country, each jurisdiction, each region, and each property. Data in this layer includes data from the worldwide languages, regional identifiers, and jurisdictional identifiers areas, among others, of the printer memory as previously disclosed in FIG. 2 and FIG. 9.

The translation layer may be used to render a protocol for use with the modular gaming transaction printer. The translation layer includes data from any area of the printer memory as previously disclosed in FIG. 2 and FIG. 9.

The character string substitution layer may include information derived from the translation layer and the location code storage layer to properly encode the data. For example, the modular gaming transaction printer may set the appropriate character string substitution using Unicode after the printer identifies the protocol layer as USB and the country in the location code storage layer as Brazil. This functionality permits the printer to generate or print gaming vouchers, promotional coupons, and other printed items of interest to a Gaming Establishment.

The font lookup table may include information related to the fonts supported by the modular gaming transaction printer. Data may be drawn from any font scaling 1409 on demand which may be pulled from the character string substitution layer as well as data from a font library 1410 stored in the modular gaming transaction printer.

Although the invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supportable by this application and the claims' equivalents rather than the foregoing description.

What is claimed is:

1. A method of operating gaming printer, comprising:

generating a coupon for the player by the gaming printer;

storing the generated coupon in an escrow location of the gaming printer by the gaming printer;

receiving a cash-out signal for the player by the gaming printer;

generating a voucher in response to the cash-out signal for the player by the gaming printer; and presenting the generated coupon from the escrow location of the gaming printer and the voucher to the player by the gaming printer.

2. The method of claim 1, wherein storing the coupon in an escrow location includes storing the coupon in a paper tray.

3. The method of claim 1, wherein the coupon is received from a host other than a gaming machine.

4. The method of claim 1, further comprising receiving a cash-in signal for the player by the gaming printer.

5. The method of claim 4, wherein the cash-in signal is received from a gaming machine.

6. The method of claim 1, wherein the cash-out signal is received from a gaming machine.

7. The method of claim 1, further comprising storing the coupon during a player session.

8. A gaming printer, comprising:

means for generating a coupon for the player by the gaming printer;

means for storing the generated coupon in an escrow location of the printer by the gaming printer;

means for receiving a cash-out signal for the player by the gaming printer;

means for generating a voucher in response to the cash-out signal for the player by the gaming printer; and means for presenting the generated coupon from the escrow location of the printer and the voucher to the player by the gaming printer.

9. The gaming printer of claim 8, further comprising a plurality of paper storage trays, wherein the escrow location includes at least one of the paper trays.

10. The gaming printer of claim 8, wherein the coupon is received from a host other than a gaming machine.

11. The gaming printer of claim 8, further comprising means for receiving a cash-in signal for the player by the gaming printer.

12. The gaming printer of claim 11, wherein the cash-in signal is received from a gaming machine.

13. The gaming printer of claim 8, wherein the cash-out signal is received from a gaming machine.

* * * * *